US005690498A

United States Patent [19]

Sobhani

[11] Patent Number: 5,690,498

[45] Date of Patent: Nov. 25, 1997

[54] SPRING LOADED ROTARY CONNECTOR

[75] Inventor: Mohi Sobhani, Encino, Calif.

[73] Assignee: He Holdings, Inc, Los Angeles, Calif.

[21] Appl. No.: 717,377

[22] Filed: Sep. 23, 1996

[51] Int. Cl.[6] ..... H01R 39/10

[52] U.S. Cl. ..... 439/22

[58] Field of Search ..... 439/22, 27, 21, 439/20, 18

[56] References Cited

U.S. PATENT DOCUMENTS 5,173,053 12/1992 Swanson et al. ..... 439/22

5,484,294 1/1996 Sobhani ..... 439/21

*Primary Examiner*—Gary F. Paumen

*Attorney, Agent, or Firm*—M. E. Lachman; M. W. Sales; W. K. Denson-Low

[57] ABSTRACT

Spring loaded rotary connectors that comprise a first wiring board having one or more sets of electrically conductive concentric circuits or rings formed thereon, that has one or more raised contacts, or looped-shaped dimples, for every ring. In a first embodiment, the first wiring board faces a second wiring board having electrically conductive concentric rings or circuits that form contacts. The first wiring board is coupled to a moving (rotating) component while the second wiring board is coupled to a stationary component, or vice-versa. The sliding rings and dimples (contacts) on the adjacent wiring boards permit signals and power to be transferred from the moving part of the connector to the stationary part thereof. In a second embodiment of the connector, a second side of the first wiring board is configured to have the conductive rings and dimples, and a third wiring board that is substantially identical to the second wiring board is disposed adjacent to the first wiring board on the opposite side thereof from the second wiring board. Appropriate electrical conductors are connected to each active concentric ring of the wiring boards to provide electrical connection thereto.

15 Claims, 3 Drawing Sheets

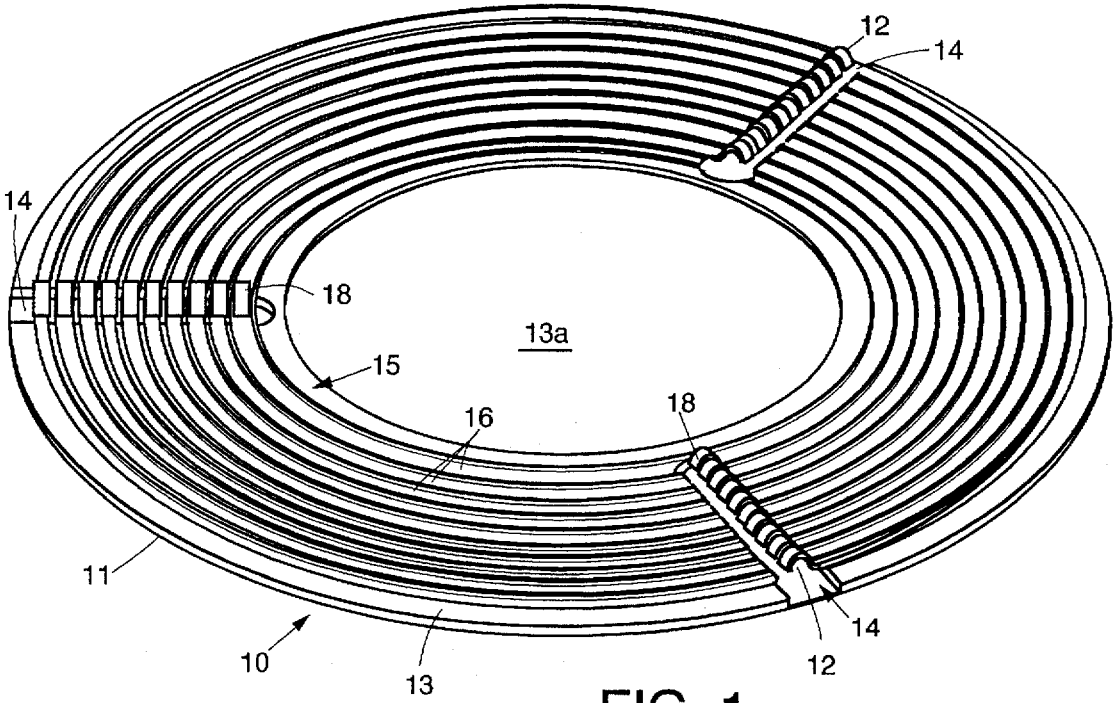
FIG. 1.
FIG.2.
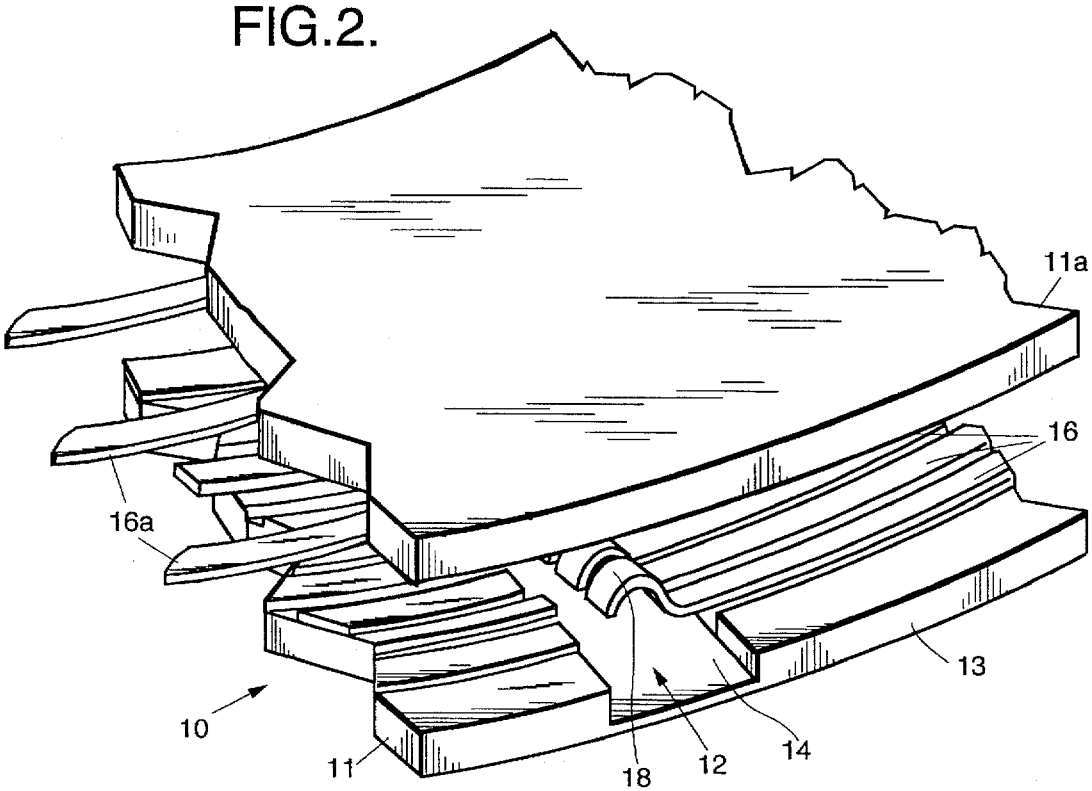

SPRING LOADED ROTARY CONNECTOR

BACKGROUND

The present invention relates generally to rotary connectors, and more particularly, to improved spring loaded rotary connectors.

Conventional rotary connectors employ the use of cable-wrap connectors, slip rings, roll rings, brushes and motors, and telephone wire coils. The disadvantages of conventional rotary connector designs are as follows.

Cable-wrap connectors have low reliability. Slip rings have low reliability and have an unworkable geometry. Roll rings are costly and have an unworkable geometry. Brush and motor designs are not applicable to the design of rotary connectors, and are expensive. Similarly, telephone wire coils are bulky, and are not generally applicable to the design of rotary connectors.

Accordingly, it is an objective of the present invention to provide for improved spring loaded rotary connectors.

SUMMARY OF THE INVENTION

To meet the above and other objectives, the present invention provides for spring loaded rotary connectors that, in one embodiment, comprises a first wiring board having an electrically conductive sheet, such as a beryllium copper sheet having different varieties of plating thereon, for example, formed on one surface thereof that has a plurality of concentric conductive rings formed thereon, and that for every ring (contact), there are one or more raised contacts. The raised contacts are provided by a plurality of loop-shaped dimples. The first wiring board faces a second wiring board having conductive rings that form contacts that align with the raised contacts of the first wiring board. The second wiring board does not have the loop-shaped dimples or cavities found in the first wiring board. The concentric conductive rings of the second wiring board may be segmented depending upon the application of the connector. The first wiring board is coupled to a moving (rotating) component while the second wiring board is coupled to a stationary component, or vice-versa. The sliding rings and dimples (contacts) on the adjacent wiring boards permit signals and power to be transferred from the moving part of the connector to the stationary part of the connector.

In a second embodiment of the connector, a second side of the first wiring board is configured to have the conductive rings and dimples. A third wiring board that is substantially identical to the second wiring board is disposed adjacent to the first wiring board on the opposite side thereof from the second wiring board. Appropriate electrical conductors are connected to each active concentric ring of the wiring boards to provide electrical connection thereto.

The purpose of the present spring loaded rotary connector is to make electrical contact between a stationary part of the connector to the moving part of the connector without electrical signal degradation. The spring loaded rotary connector may thus be used to replace unreliable slip rings and cable-wrap connectors. Advantages of the present spring loaded rotary connector include lower cost, smaller size, higher reliability, and less volume than conventional slip rings and cable-wrap connectors, for example. Furthermore, the present rotary connector may be easily replaced in the field for those systems that are found to have defective connectors, without requiring return of the systems to the factory or to a repair depot.

The present spring loaded rotary connector may be used in military, commercial and industrial applications, such as on military aircraft and avionics, automotive products and display products, for example.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which:

FIG. 1 shows a perspective view of a first embodiment of a wiring board used in a spring loaded rotary connector in accordance with the principles of the present invention; and FIG. 2 shows an enlarged portion of the present spring loaded rotary connector;

DETAILED DESCRIPTION

Figure 3:
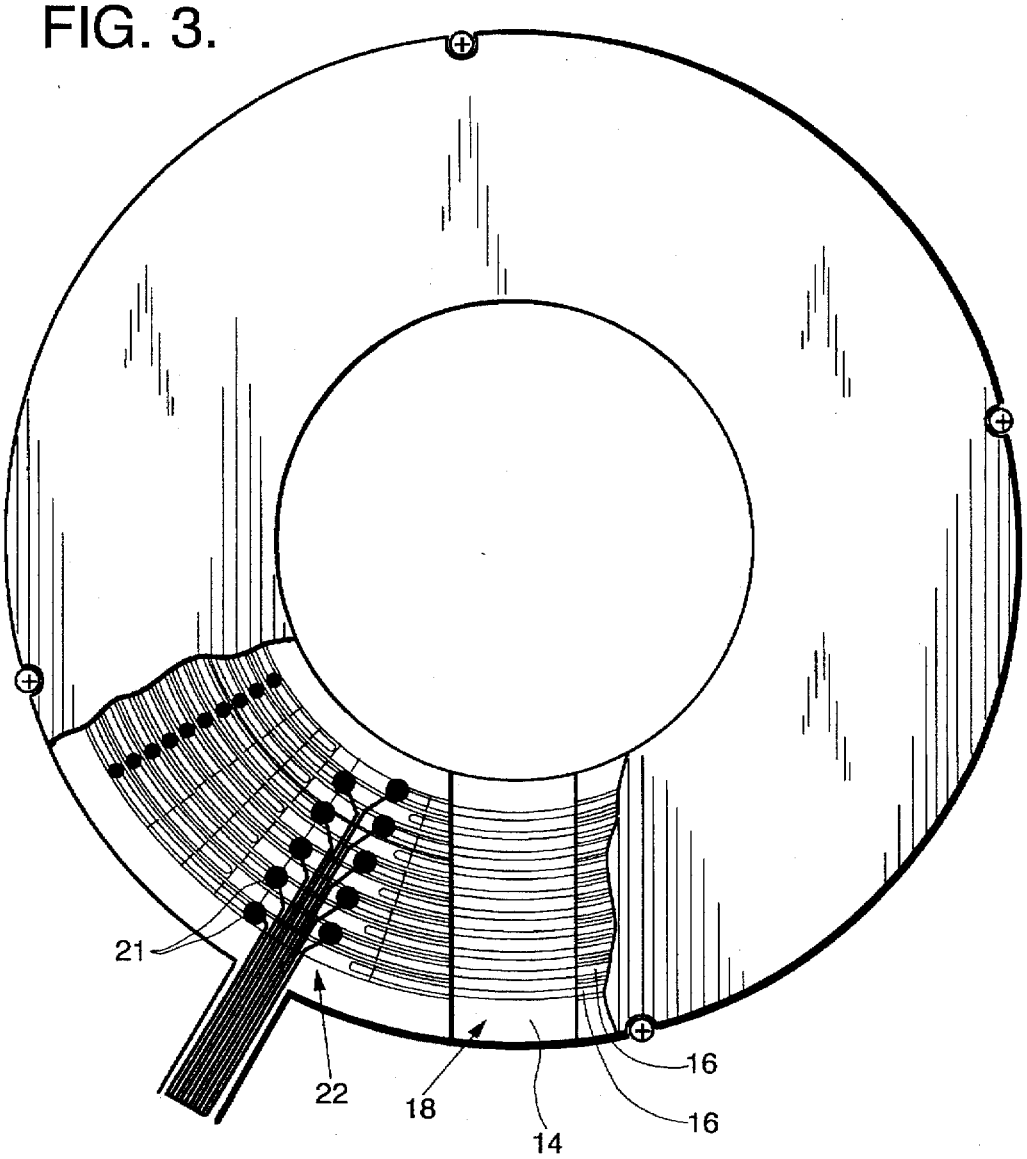
FIG. 3 shows a partially exposed top view of view of the spring loaded rotary connector showing one set of electrical connections made thereto.

Referring to the drawing figures, FIG. 1 shows a perspective view of an embodiment of a first wiring board 11 used in a spring loaded rotary connector 10 in accordance with the principles of the present invention.

With reference to FIG. 1, the first wiring board 11 comprises a dielectric substrate 13 which is preferably circular, in which a plurality of cavities 14 are formed. The dielectric substrate 13 has a central opening 13*a* formed therein. A metallic, electrically conductive sheet 15, such as a beryllium copper sheet 15 is laminated or otherwise affixed to one surface of the dielectric substrate 13. The conductive sheet 15 is then processed to form a plurality of conductive circuits 16 or traces 16 that are concentrically disposed on the surface of the conductive sheet 15 around the central opening 13*a*.

The circuits 16 are cut adjacent one edge of each of the cavities 14. The circuits 16 are bent to form loop-shaped dimples 18. A comb-shaped nonmetallic member 17 (FIG. 4) which may be comprised of plastic, for example, may be disposed over exposed ends of the loop-shaped dimples 18. The comb-shaped nonmetallic member 17 may be used to ensure separation of formed dimples 18 from each other and to collect unwanted particles caused by wear of the circuits 16 or dimples 18.

Referring to FIG. 2, it shows an enlarged portion of an assembled spring loaded rotary connector 10. A second wiring board 11*a* is disposed adjacent to the first wiring board 11. The spring loaded contacts 12 formed on the first wiring board 11 contact a plurality of conductive traces 16*a* (only a few of which are shown) formed on the second wiring board 11*a*. In practice, one of the wiring boards 11, 11*a* is attached to a fixed member while the other is attached to a rotatable member. Consequently, the dimples 18 rub against the plurality of conductive traces 16*a* and thus make electrical contact therewith which permits coupling of electrical signals therebetween.

FIG. 3 shows a partially exposed top view of a first embodiment of the spring loaded rotary connector 10 which also illustrates a set of electrical connections 21 made thereto. The second wiring board 11*a* is constructed in substantially the same manner as the first wiring board 11, but no dimples 18 or cavities 14 are formed thereon. The plurality of conductive traces 16*a* formed on the second wiring board 11*a* are aligned with the respective dimples 18 of the first wiring board 11, and contact the conductive traces 16 on the first wiring board 11. The plurality of conductive traces 16*a* on the second wiring board 11*a* may be continuous or segmented, depending upon the application for which the connector 10 is to be used.

As is shown in FIGS. 1 and 3, each of the plurality of conductive circuits 16 or traces 16 on the first wiring board 11 may be formed in a plurality of separate sections, three for example, that each include one dimple 18. The conductive traces 16 on the second wiring board 11*a* are typically continuous, but may be segmented to meet specific requirements. Each of the plurality of conductive circuits 16 or traces 16 on the first wiring board 11 are formed such that spaces 22 are provided between respective portions thereof. The electrical connections 21 may be made by soldering to exposed ends of the conductive circuits 16 or traces 16 adjacent edges of the spaces 22.

Figure 4:
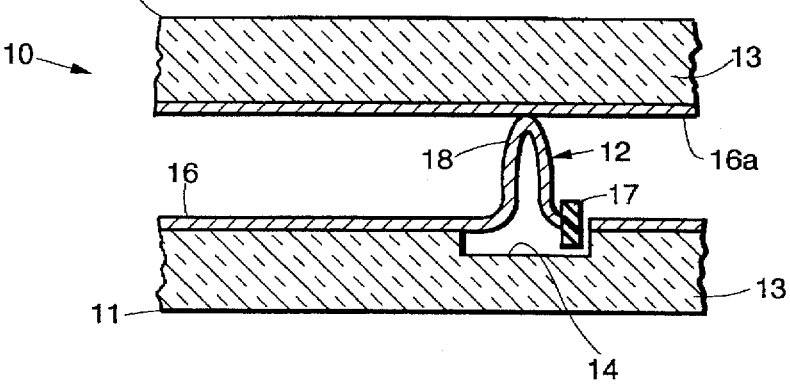
FIG. 4 illustrates a partial side view of a first embodiment of the spring loaded rotary connector of the present invention.

FIG. 4 illustrates a partial side view illustrating a first embodiment of the spring loaded rotary connector 10. The first embodiment of the spring loaded rotary connector 10 uses the first and second wiring boards 11, 11*a* disposed adjacent to each other such that the dimples 18 formed on one side of the first wiring board 11 contact concentric rings 16*a* (conductive circuits 16*a* or traces 16*a*) that form the contacts on the second wiring board 11*a*.

Figure 5A:
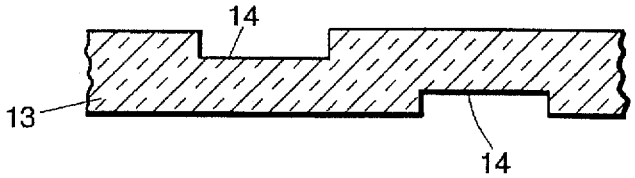
FIGS. 5*a*–5*d* illustrate steps in manufacturing two embodiments of the present spring loaded rotary connector.
Figure 5B:
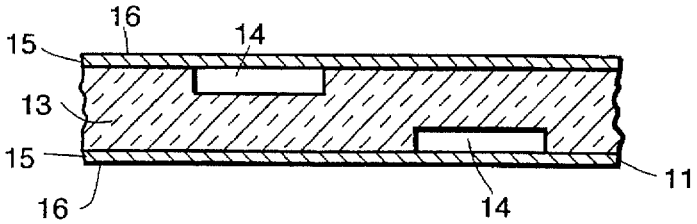
Figure 5C:
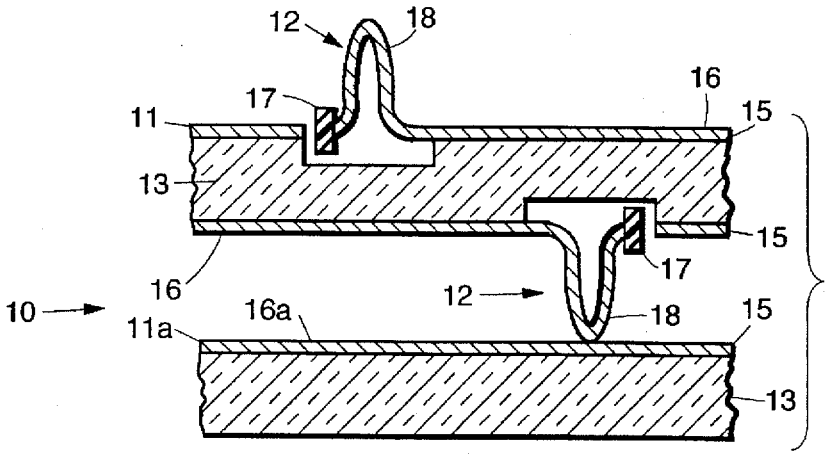

FIGS. 5*a*–5*c* illustrate steps in manufacturing the first embodiment of the spring loaded rotary connector 10. The cavities 14 are created in the first wiring board 11 prior to lamination of the electrically conductive sheet 15, such as the beryllium copper sheet, for example. The conductive sheet 15 may have a thickness on the order of from three to five mils. After imaging, plating, etching and replating of the conductive sheet 15 to obtain a desired thickness of the circuits 16 (if required), the circuits 16 are cut at specific locations, typically adjacent to the edges of each of the cavities 14. Fabrication of the conductive sheet 15 is accomplished in a conventional manner well known to those skilled in the art of printed wiring board manufacture. A tool is used to form these circuits 16 so that they form the loop-shaped dimples 18. The comb-shaped nonmetallic member 17 may then be disposed over the exposed ends of the dimples 18. A second wiring board 11*a* is constructed without fabricating the loop-shaped dimples 18 or cavities 14 such that it has continuous or segmented conductive circuits 16*a* formed thereon.

After soldering appropriate wires to make the electrical connections 21 to the first wiring board 11, the two wiring boards 11, 11*a* are assembled with their respective conductive circuits 16, 16*a* facing each other. This assembly functions as a rotary connector. Typically, one wiring board 11 is attached to a rotating shaft while the other wiring board 11*a* is held stationary.

Figure 5D:
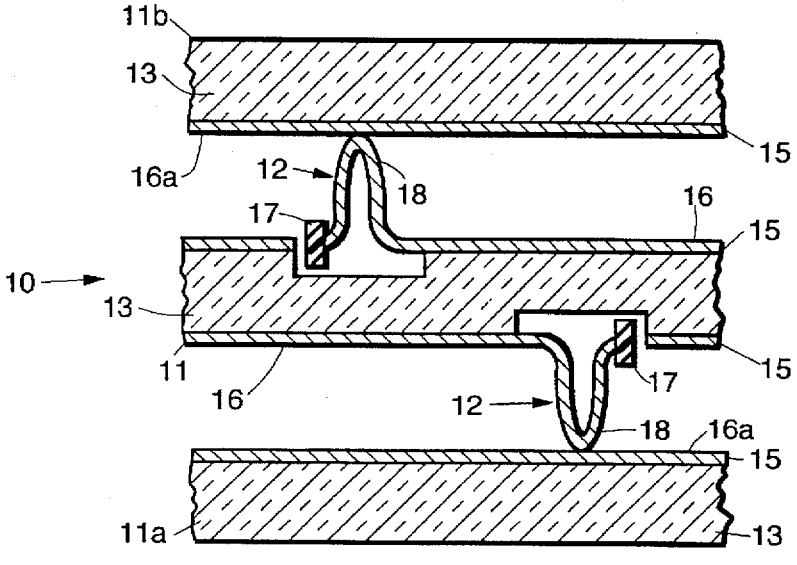

FIG. 5*d* illustrates the second embodiment of the spring loaded rotary connector 10. The second embodiment of the spring loaded rotary connector 10 uses a first or center wiring board 11 having dimples 18 formed on both sides thereof. The second plurality of conductive circuits 16 and loop-shaped dimples 18 may be formed on the second surface of the first wiring board 11 as discussed above. This permits the use of the third wiring board 11*b* adjacent the second surface, which provides for double the number of contacts.

The second wiring board 11*a* is disposed such that the concentric rings 13*a* that form its contacts contact the dimples 18 on one side of the center wiring board 11. A third wiring board 11*b* that is substantially the same as the second wiring board 11*a* is disposed such that the concentric rings 16*a* that form its contacts contact the dimples 18 on the opposite side of the center wiring board 11. The second embodiment of the spring loaded rotary connector 10 provides twice as many contacts as the first embodiment.

Thus, improved spring loaded rotary connectors have been disclosed. It is to be understood that the described embodiments are merely illustrative of some of the many specific embodiments which represent applications of the principles of the present invention. Clearly, numerous and varied other arrangements may be readily devised by those skilled in the art without departing from the scope of the invention.

What is claimed is:

1. A spring loaded rotary connector comprising:

a first wiring board comprising:

a first dielectric substrate having a plurality of cavities formed therein; and a first plurality of conductive circuits concentrically disposed on a first surface of the dielectric substrate that are cut into a plurality of sections and that are bent to form loop-shaped dimples extending across the cavities;

a second wiring board disposed adjacent to the first surface of the first printed wiring board that comprises:

a second dielectric substrate; and a second plurality of conductive circuits concentrically disposed on a surface of the second dielectric substrate;

and wherein the first and second wiring boards are disposed such that the dimples formed on the first wiring board contact the conductive circuits on the second wiring board; and a plurality of electrical conductors coupled to the respective pluralities of conductive circuits of the first and second wiring boards.

2. The connector of claim 1 wherein the first and second plurality of conductive circuits comprise beryllium copper.

3. The connector of claim 1 wherein the first and second plurality of conductive circuits are laminated to respective surfaces of the first and second dielectric substrates.

4. The connector of claim 1 further comprising a comb-shaped nonmetallic member disposed over exposed ends of the loop-shaped dimples.

5. The connector of claim 4 wherein the comb-shaped nonmetallic member comprises plastic.

6. The connector of claim 1 wherein the second plurality of conductive circuits are cut into a plurality of sections.

7. The connector of claim 1 wherein:

the first dielectric substrate comprises a third plurality of conductive circuits concentrically disposed on a second surface of the dielectric substrate that are cut into a plurality of sections and that are bent to form loop-shaped dimples extending across the cavities;

and wherein the connector further comprises:

a third wiring board disposed adjacent to the second surface of the first printed wiring board that comprises:

a third dielectric substrate;

a fourth plurality of conductive circuits concentrically disposed on a surface of the third dielectric substrate;

and wherein the first and third wiring boards are disposed such that the dimples formed on the second surface of the first wiring board contact the conductive circuits on the third wiring board; and a plurality of electrical conductors coupled to the respective pluralities of conductive circuits of the first and third wiring boards.

8. The connector of claim 1 wherein the fourth plurality of conductive circuits are cut into a plurality of sections.

9. A spring loaded rotary connector comprising:

a first wiring board comprising:

a first dielectric substrate having a plurality of cavities formed therein;

a first plurality of conductive circuits concentrically disposed on a first surface of the dielectric substrate that are cut into a plurality of sections and that are bent to form loop-shaped dimples extending across the cavities; and a second plurality of conductive circuits concentrically disposed on a second surface of the dielectric substrate that are cut into a plurality of sections and that are bent to form loop-shaped dimples extending across the cavities;

a second wiring board disposed adjacent to the first surface of the first printed wiring board that comprises:

a second dielectric substrate; and a third plurality of conductive circuits concentrically disposed on a surface of the second dielectric substrate; and a third wiring board disposed adjacent to the second surface of the first wiring board that comprises:

a third dielectric substrate;

a fourth plurality of conductive circuits concentrically disposed on a surface of the third dielectric substrate;

and wherein the first and second wiring boards are disposed such that the dimples formed on the first surface of the first wiring board contact the conductive circuits on the second wiring board;

and wherein the first and third wiring boards are disposed such that the dimples formed on the second surface of the first wiring board contact the conductive circuits on the third wiring board; and a plurality of electrical conductors coupled to the respective pluralities of conductive circuits of the first, second and third wiring boards.

10. The connector of claim 9 wherein the respective pluralities of conductive circuits comprise beryllium copper.

11. The connector of claim 9 wherein the respective pluralities of of conductive circuits are laminated to the respective dielectric substrates.

12. The connector of claim 9 further comprising comb-shaped nonmetallic members disposed over exposed ends of the loop-shaped dimples.

13. The connector of claim 12 wherein the comb-shaped nonmetallic member comprises plastic.

14. The connector of claim 9 wherein the third plurality of conductive circuits are cut into a plurality of sections.

15. The connector of claim 9 wherein the fourth plurality of conductive circuits are cut into a plurality of sections.

* * * * *